US012593865B2

(12) United States Patent
Matsuba et al.

(10) Patent No.: US 12,593,865 B2
(45) Date of Patent: Apr. 7, 2026

(54) MEMBER FOR FLAVOR INHALATION ARTICLE, FLAVOR INHALATION ARTICLE, PHENOL SCAVENGER FOR FLAVOR INHALATION ARTICLE, AND METHOD FOR PRODUCING FLAVOR INHALATION ARTICLE

(71) Applicant: Japan Tobacco Inc., Tokyo (JP)

(72) Inventors: Ryota Matsuba, Tokyo (JP); Hiroyuki Kubota, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 504 days.

(21) Appl. No.: 17/543,969

(22) Filed: Dec. 7, 2021

(65) Prior Publication Data

US 2022/0087312 A1 Mar. 24, 2022

Related U.S. Application Data

(63) Continuation of application No. PCT/JP2019/026458, filed on Jul. 3, 2019.

(51) Int. Cl.
*A24D 3/02* (2006.01)

(52) U.S. Cl.
CPC ..... *A24D 3/0212* (2013.01); *A24D 3/0275* (2013.01)

(58) Field of Classification Search
None
See application file for complete search history.

(56) References Cited

U.S. PATENT DOCUMENTS 3,675,541 A * 7/1972 Tokitomo ..... A24D 3/10 264/DIG. 48
3,903,900 A * 9/1975 Wolt ..... A23L 27/2052 131/276

(Continued)

FOREIGN PATENT DOCUMENTS

CN 102458164 A 5/2012
CN 106572957 A 4/2017

(Continued)

OTHER PUBLICATIONS https://www.thegoodscentscompany.com/data/rw1026301.html (Glyceryl monooleate data).*

(Continued)

*Primary Examiner* — Jill A Warden
(74) *Attorney, Agent, or Firm* — Birch, Stewart, Kolasch & Birch, LLP

(57) ABSTRACT

Provided is a member for a flavor inhalation article that has sufficient selective filtering performance with respect to phenols and has exceptional storage stability. The member for a flavor inhalation article includes: a base member; and a phenol scavenger carried by the base member and comprising a substance satisfying formulae (1) to (3) below:

$$HSP(\text{phenol}) \leq 8, \quad (1)$$

$$Vp \leq 0.2 \text{ Pa}, \quad (2)$$

$$DP \geq 50^\circ \text{ C}. \quad (3)$$

where the HSP (phenol) is a distance between a Hansen solubility parameter of the substance and a Hansen (Continued)

solubility parameter of phenol, the Vp is a vapor pressure of the substance, and the DP is a dropping point of the substance.

8 Claims, 8 Drawing Sheets

(56) References Cited

U.S. PATENT DOCUMENTS

| | | | | |
|---|---|---|---|---|
| 9,032,970 | B2 * | 5/2015 | Szarvas | A24D 3/16 131/334 |
| 10,039,890 | B2 | 8/2018 | Chida et al. | |
| 2012/0132219 | A1 | 5/2012 | Szarvas | |
| 2013/0160779 | A1 | 6/2013 | Chida et al. | |
| 2015/0083146 | A1 * | 3/2015 | Goldman | A61K 31/352 131/352 |
| 2017/0143608 | A1 | 5/2017 | Szeki | |
| 2019/0000135 | A1 * | 1/2019 | Lavanant | A24B 15/40 |

FOREIGN PATENT DOCUMENTS

| | | | | | |
|---|---|---|---|---|---|
| CN | 107846971 | A | | 3/2018 | |
| JP | 9-294576 | A | | 11/1997 | |
| JP | 9-294577 | A | | 11/1997 | |
| JP | 2002-204683 | A | | 7/2002 | |
| JP | 2007-268351 | A | | 10/2007 | |
| JP | 2012-525140 | A | | 10/2012 | |
| JP | 2014230489 | A | * | 12/2014 | A24D 3/043 |
| JP | 2018-623476 | A | | 8/2018 | |
| WO | WO 2010/125412 | A1 | | 11/2010 | |
| WO | WO 2012/023515 | A1 | | 2/2012 | |
| WO | WO 2013/042609 | A1 | | 3/2013 | |

OTHER PUBLICATIONS

JP2014230489A, Cigarette, (Year: 2014).* https://www.thegoodscentscompany.com/data/rw1026301.html (Glyceryl monooleate data). (Year: 1980).*

Russian Office Action and Search Report for Russian Application No. 2022100298/03, dated Jul. 11, 2022, with English translation.

Extended European Search Report for European Application No. 19935845.8, dated Dec. 22, 2022.

English translation of International Preliminary Report on Patentability and Written Opinion of the International Searching Authority for International Application No. PCT/JP2019/026458, dated Jan. 13, 2022.

International Search Report, issued in PCT/JP2019/026458, dated Oct. 1, 2019.

Written Opinion of the International Searching Authority, issued in PCT/JP2019/026458, dated Oct. 1, 2019.

Chinese Office Action for Chinese Application No. 201980097922, dated Mar. 8, 2024, with English translation.

* cited by examiner

MEMBER FOR FLAVOR INHALATION ARTICLE, FLAVOR INHALATION ARTICLE, PHENOL SCAVENGER FOR FLAVOR INHALATION ARTICLE, AND METHOD FOR PRODUCING FLAVOR INHALATION ARTICLE

CROSS-REFERENCE TO RELATED APPLICATIONS

This application is a Continuation Application of PCT Application No. PCT/JP2019/026458, filed Jul. 3, 2019, the entire contents of which are incorporated herein by reference.

FIELD

The present invention relates to a flavor inhalation article member, a flavor inhalation article, a phenol scavenger for flavor inhalation article, and a method for producing a flavor inhalation article member.

BACKGROUND

For filters of flavor inhalation articles such as cigarettes and non-combustion type tobacco, reduction in undesirable components in mainstream smoke while maintaining flavor is required. As one method for achieving this, it is known that a substance having selective filtering performance with respect to a particular component is carried by a filter as an additive. When the additive leaks out of the filter, the selective filtering performance with respect to the particular component is decreased. Therefore, such a filter requires storage stability in which the additive remains in the filter in an amount sufficient to maintain the selective filtering performance until inhalation by a user.

A component to be filtered from mainstream smoke generated when a flavor inhalation article is burned or heated may be phenol that is a substance known to cause irritation. If phenol is selectively filtered, flavor can be enhanced.

BRIEF SUMMARY OF THE INVENTION

As additives for providing selective filtering performance with respect to phenol to a filter, triacetin (glycerol triacetate (GTA)), triethyl citrate (TEC), and the like are known. However, a filter using these additives has room for improvement in storage stability.

An object of the present invention is to provide a flavor inhalation article member having sufficient selective filtering performance with respect to phenol and excellent storage stability.

According to one embodiment, there is provided a flavor inhalation article member including:

a base member; and a phenol scavenger carried by the base member and including a substance satisfying formulae (1) to (3) below.

According to another embodiment, there is provided a flavor inhalation article including the flavor inhalation article member according to the embodiment.

According to another embodiment, there is provided a phenol scavenger for flavor inhalation article including a substance satisfying formulae (1) to (3) below.

According to another embodiment, there is provided a method for producing a flavor inhalation article member, including making a base member carry a phenol scavenger for flavor inhalation article containing a substance satisfying the following formulae (1) to (3):

$$HSP(\text{phenol}) \leq 8 \quad (1)$$

$$Vp \leq 0.2 \text{ Pa} \quad (2)$$

$$DP \geq 50^\circ \text{ C.} \quad (3)$$

where the HSP (phenol) is a distance between a Hansen solubility parameter of the substance and a Hansen solubility parameter of phenol, the Vp is a vapor pressure of the substance, and the DP is a dropping point of the substance.

According to the present invention, it is possible to provide a flavor inhalation article member having sufficient selective filtering performance with respect to phenol and excellent storage stability.

DETAILED DESCRIPTION

Figure 1:
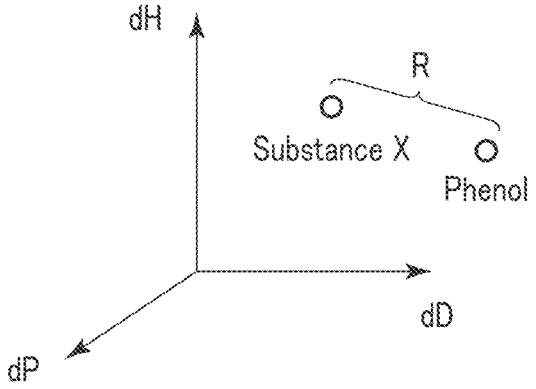
FIG. 1 shows Hansen solubility parameters of a substance on three-dimensional coordinates.

Hereinafter, the present invention will be described in detail, and the following description is intended to describe the invention in detail and is not intended to limit the invention.

A phenol scavenger according to an embodiment is a phenol scavenger for flavor inhalation article containing a substance satisfying the following formulae (1) to (3):

$$HSP(\text{phenol}) \leq 8 \quad (1)$$

$$Vp \leq 0.2 \text{ Pa} \quad (2)$$

$$DP \geq 50^\circ \text{ C.} \quad (3)$$

where the HSP (phenol) is a distance between a Hansen solubility parameter of the substance and a Hansen solubility parameter of phenol, the Vp is a vapor pressure of the substance, and the DP is a dropping point of the substance.

1. Flavor Inhalation Article Member

While searching for a flavor inhalation article member having selective filtering performance with respect to phenol and excellent storage stability, the present inventors found that a desired effect is obtainable by a flavor inhalation article member in which glyceryl monooleate is carried by a base member as an additive (phenol scavenger). Thus, various parameters were measured for glyceryl monooleate. The measured parameters will be described below. Although a description for the base member will be provided later, the base member may be one of a member constituting a smoking article such as cigarette, a member constituting a non-combustion heating type flavor inhalation article, and a member constituting a non-combustion non-heating type flavor inhalation article.

Among parameters specified for a given substance, a parameter influencing the phenol selective filtering performance may be Hansen Solubility Parameters (HSPS).

The Hansen solubility parameter is obtained by decomposing solubility parameter δt (SP) introduced by Mr. Hildebrand into dispersion force contribution term δd between molecules, dipole interaction contribution term δp between molecules, and hydrogen bond contribution term δh between molecules, thereby extending an applicable substance to a polar substance and a substance generating hydrogen bonding. In the present specification and claims, the expression "Hansen solubility parameter" means a Hansen solubility parameter at 25° C. unless the temperature is described. The relationship between the solubility parameter δt and the three contribution terms is shown in the following formula:

$$\delta_t^2 = \delta_d^2 + \delta_p^2 + \delta_h^2 \quad \text{[Formula 1]}$$

The three parameters of the dispersion force contribution term δd, the dipole interaction contribution term δp, and the hydrogen bond contribution term δh can be regarded as coordinates in a three-dimensional space with the respective parameters as axes. Since various substances have specific HSPs at a specified temperature, HSPs of these substances are represented as points at different positions in the three-dimensional space as shown in FIG. 1. The solubility (compatibility) between given substance i and another substance j is considered to be higher as distance Rij between two points represented by the following formula becomes smaller.

$$R_{ij} = \sqrt{\left\{4\left(\delta_d^i - \delta_d^j\right)^2 + \left(\delta_p^i - \delta_p^j\right)^2 + \left(\delta_h^i - \delta_h^j\right)^2\right\}} \quad \text{[Formula 2]}$$

Accordingly, a magnitude of influence of given substance X on phenol selective filtering performance can be evaluated by obtaining a distance between a position of HSP of phenol and a position of HSP of the given substance X in the three-dimensional space. In the present specification and claims, the distance Rij obtained from the Hansen solubility parameter of phenol and the Hansen solubility parameter of the given substance X according to the above formula is defined as HSP (phenol).

The HSP (phenol) of glyceryl monooleate is 7.14. It can be determined that a substance having an HSP (phenol) of 8 or less may realize practical phenol selective filtering performance. This is based on the fact that propylene glycol, which has been confirmed to realize high phenol selective filtering performance, has an HSP (phenol) of 8. The flavor inhalation article member according to the embodiment includes a phenol scavenger containing a substance having an HSP (phenol) of 8 or less. The HSP (phenol) of the substance contained in the phenol scavenger is preferably as small as possible, and is, for example, 0 or more. The HSP (phenol) of the substance may be 0.5 or more, 1 or more, 2 or more, or 5 or more.

Parameters influencing the storage stability may be vapor pressure Vp and dropping point DP. The reason will be described.

A flavor inhalation article is generally stored for a long period of time in an enclosed space covered with a polypropylene film. There is a possibility that an additive added to a flavor inhalation article member such as a filter will migrate into tobacco shreds during a long-term storage. On the other hand, the additive needs to remain in a filter or the like in order to selectively filter a particular component when a user inhales flavor.

Migration of the additive from the filter or the like into the tobacco shreds occurs mainly through vapor phase. Therefore, in order to suppress this migration, the additive desirably contains a substance having a low vapor pressure.

The vapor pressure Vp of glyceryl monooleate is 0 Pa at 25° C. In the present specification and claims, the term "vapor pressure" means a vapor pressure at 25° C. unless a temperature is described. For the reason described above, the vapor pressure Vp of the substance contained in the phenol scavenger (additive) according to the embodiment is desirably 0 Pa at 25° C. However, the vapor pressure Vp at 25° C. does not need to be 0 Pa, and if it is 0.2 Pa or less, migration of the scavenger into the tobacco shreds is unlikely to occur. This was found from the evaluation of the migration amount into the shreds described below.

(Evaluation of Migration Amount into Shreds)

Figure 2:
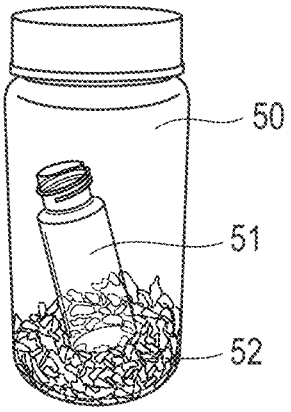
FIG. 2 shows an example of a screw tube bottle in evaluation of a migration amount into shreds.

First, tobacco shreds 52 for one cigarette are loosened and put into a first screw tube bottle 50 that can be sealed. In this evaluation, it is assumed that the mass of tobacco shreds for one cigarette is 560 mg. As the first screw tube bottle 50, Standard No. 7 (volume 50 mL) manufactured by Maruemu Corporation is used. Another second screw tube bottle 51 is prepared, and 0.5 mL of an evaluation target substance is put in the second screw tube bottle 51. As the second screw tube bottle 51, Standard No. 1 (volume 4 mL) manufactured by Maruemu Corporation is used. The second screw tube bottle 51 containing the evaluation target substance is placed without being covered with a lid inside the first screw tube bottle 50, and the first screw tube bottle 50 is covered with a lid. In this manner, a state is created in which the evaluation target substance and the tobacco shreds 52 coexist in the sealed system inside the first screw tube bottle 50. The first screw tube bottle 50 prepared as described is stored for 3 weeks in an environment of 55° C. and 60% RH. FIG. 2 is a view schematically showing a state in which the prepared first screw tube bottle 50 is stored. After storage for 3 weeks, the migration amount of the evaluation target substance into the tobacco shreds is determined by gas chromatography.

This test was conducted for each of the five substances shown below. The evaluation target substances were ethylene glycol, propylene glycol, 1,3-butanediol, diethyl succinate, and tributyl phosphate.

Figure 3:
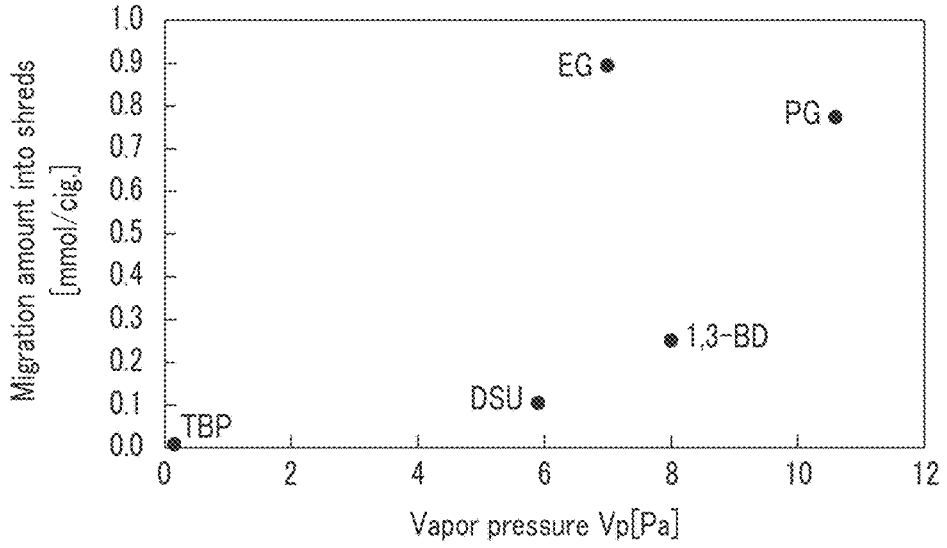
FIG. 3 is a graph in which the migration amount into the shreds with respect to a vapor pressure is plotted.

For these substances, the vapor pressure Vp at 25° C. and the amount of migration (the amount of adsorption) to the shreds are collectively shown in Table 1 below and FIG. 3. FIG. 3 is a graph in which the amount of migration to the shreds with respect to the vapor pressure is plotted for each substance. In the graph shown in FIG. 3, the horizontal axis represents the vapor pressure Vp [Pa] while the vertical axis represents the amount of migration to the shreds [mmol/cig.]. In FIG. 3, EG represents ethylene glycol, PG represents propylene glycol, 1,3-BD represents 1,3-butanediol, DSU represents diethyl succinate, and TBP represents tributyl phosphate.

TABLE 1

| Substance | Vapor Pressure (Pa) at 25° C. | Migration Amount into Tobacco Shreds (mmol/cig.) |
|---|---|---|
| Ethylene glycol | 7 | 0.895 |
| Propylene glycol | 10.6 | 0.774 |
| 1,3-butanediol | 8 | 0.252 |
| Diethyl succinate | 5.9 | 0.105 |
| Tributyl phosphate | 0.151 | 0.008 |

As shown in Table 1 and FIG. 3, when tributyl phosphate having a vapor pressure Vp of 0.2 Pa or less was used, almost no migration into the tobacco shreds occurred. That is, with a substance having a vapor pressure Vp of 0.2 Pa or less at 25° C., it is possible to suppress migration of the substance into the tobacco shreds through vapor phase. The vapor pressure of the substance is more preferably 0.1 Pa or less, and even more preferably 0 Pa substantially. According to one embodiment, the vapor pressure of the substance is in a range from 0 Pa or more and 0.20 Pa or less.

The phenol scavenger carried by a filter or the like may leak out from the filter or the like during storage, causing a stain on cigarette paper or tipping paper. This leakage tends to be more significant when the phenol scavenger contains a substance having a low dropping point. A storage temperature of cigarettes may be, for example, around 50° C. in a vending machine. Therefore, a substance contained in the phenol scavenger is preferably a substance that is not easily fluidized even in such environments.

A substance having a dropping point (DP) of 50° C. or higher is less likely to be fluidized under relatively high temperature storage conditions, e.g., in a vending machine having a high temperature. Therefore, if such a substance is used in a filter or the like, for example, a stain is not easily caused on cigarette paper or tipping paper. Furthermore, when the phenol scavenger contains a substance that is less likely to leak out from a filter or the like, the substance is likely to remain in the filter or the like, and therefore, a member having excellent phenol selective filtering performance can be realized. Since the dropping point of glyceryl monooleate is 78° C., fluidization does not easily occur during storage. The upper limit of the dropping point of the substance contained in the phenol scavenger is not particularly limited, and is, for example, 150° C. The dropping point of the substance is preferably in a range from 50° C. to 130° C. When the dropping point of the substance is excessively high, the phenol scavenger containing the substance may not be easily carried by a filter or the like, which is not preferable. The dropping point of the substance can be measured according to JIS K2220:2013.

As described above, when a phenol scavenger containing a substance satisfying the above formulas (1) to (3) is carried by a base member constituting a flavor inhalation article, the flavor inhalation article containing this member exhibits sufficient selective filtering performance with respect to phenol, and has excellent storage stability.

The flavor inhalation article having excellent storage stability has a high ability to selectively filter phenol even after long-term storage and therefore can maintain flavor. That is, a taste of the flavor inhalation article is less likely to change. Furthermore, the flavor inhalation article according to the embodiment can maintain a good appearance even after long-term storage.

The manner in which the phenol scavenger scavenges phenol is not particularly limited. The phenol scavenger may be a phenol scavenger that physically adsorbs phenol or that is compatible with phenol.

The substance contained in the phenol scavenger is not limited to glyceryl monooleate. As the substance contained in the phenol scavenger, any substance can be used as long as it satisfies the conditions described above.

In general, a "dropping point" is a physical property specified for a substance that is semisolid at room temperature such as grease, but a "dropping point" herein is a physical property specified not only for a substance that is semisolid at room temperature but also for a substance that is solid at room temperature. A dropping point of a substance that is solid at room temperature is, for example, equal to its melting point.

Here, room temperature refers to a range from 20° C.±15° C. defined by JIS Z 8703 of Japanese Industrial Standards (JIS). In order to satisfy the requirement of being semisolid at room temperature, the substance needs to be semisolid under an environment of 5° C. and also semisolid under an environment of 35° C.

A semisolid substance is a non-Newtonian fluid exhibiting a viscoelastic behavior. In other words, a semisolid substance is a composition or compound that does not flow at room temperature and low shear forces, but exhibits plastic, pseudoplastic or thixotropic flow behavior when the shear force is increased.

The substance contained in the phenol scavenger is, for example, at least one selected from the group consisting of glyceryl monooleate, benzoic acid, zingerone, cyclotene, and maltol. Every substance included in this substance group satisfies all of the above formulae (1) to (3). The substance contained in the phenol scavenger may be a mixture obtained by mixing two or more kinds of substances satisfying all of the above formulae (1) to (3). This mixture may also satisfy the above formulae (1) to (3).

The phenol scavenger may further contain a known plasticizer.

A parameter influencing the storage stability may further be partition coefficient Log P. The reason will be described.

As described above, during the storage period of the flavor inhalation article, the phenol scavenger carried by the filter may be migrated to the tobacco shreds mainly through vapor phase. In the case of a phenol scavenger containing a substance having a high affinity for tobacco shreds, the volatilized substance is rapidly absorbed (adsorbed) into the tobacco shreds. Therefore, a partial pressure of the volatilized substance is likely to decrease in the vapor phase inside the flavor inhalation article. The decreased partial pressure of the substance in the vapor phase provides an environment in which volatilization of the substance from the filter is more likely to occur. Therefore, by using a phenol scavenger containing a substance having a low affinity for tobacco shreds, the substance reaches close to a saturated vapor pressure in a package and a state of equilibrium can be maintained easily. As a result, volatilization of the substance from the filter is less likely to occur.

An index for evaluating an affinity for tobacco shreds is the partition coefficient Log P described above. The partition coefficient Log P is essentially an index to indicate hydrophobicity or a migration property of a given chemical substance. Here, the partition coefficient Log P refers to an octanol/water partition coefficient (Log $P_{ow}$) using water and n-octanol at 25° C. The partition coefficient Log P is a value obtained by measuring an equilibrium solubility ratio when a substance is dissolved in a liquid composed of two phases of water and octanol, and P=(substance concentration in octanol phase)/(substance concentration in water phase). Thus, hydrophobicity of a given substance is high as a value of partition coefficient Log P increases.

Among components contained in the tobacco shreds, a component that absorbs a substance capable of scavenging phenol is mainly water. Therefore, if a substance having a high Log P, i.e., having a high hydrophobicity, is employed as a substance that may scavenge phenol, it is possible to create an environment in which the partial pressure of the substance does not easily decrease in the flavor inhalation article. In other words, a substance having a high Log P does not easily evaporate from a filter or the like, and thus can remain in the filter or the like for a long period of time.

Figure 4:
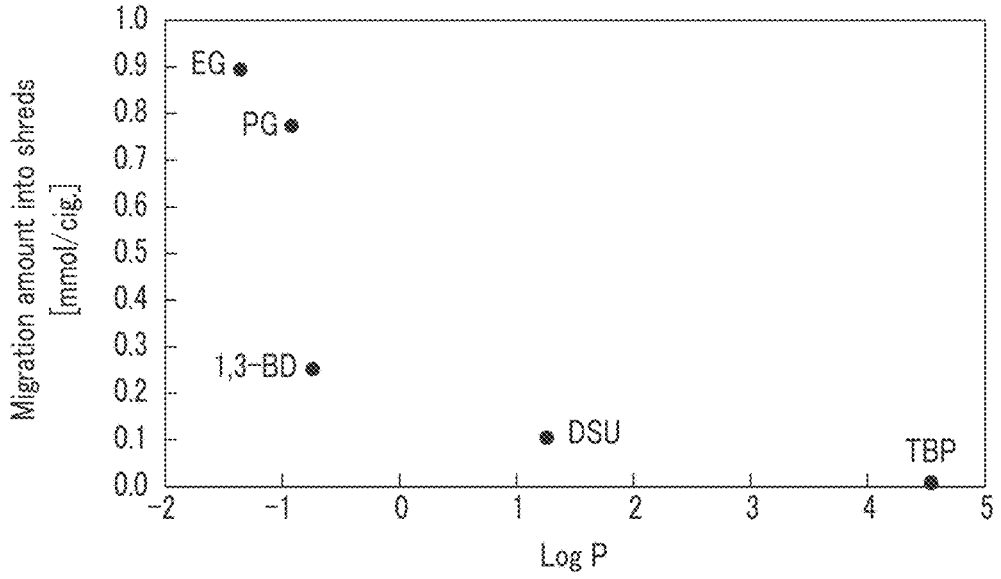
FIG. 4 is a graph in which the migration amount into the shreds with respect to a distribution coefficient is plotted.

The partition coefficient Log P of the substance contained in the phenol scavenger is desirably 4.5 or more at 25° C. This was found based on the above-described evaluation of the migration amount into the shreds. For the substances evaluated in the evaluation of the migration amount into the shreds, their Log P at 25° C. and the migration amount (the adsorption amount) into the tobacco shreds are collectively shown in Table 2 below and FIG. 4. FIG. 4 is a graph in which the migration amount into the shreds with respect to the partition coefficient Log P is plotted for each substance. In the graph shown in FIG. 4, the horizontal axis represents the Log P while the vertical axis represents the migration amount into the shreds [mmol/cig.]. The abbreviations used in FIG. 4 are synonymous with those used in FIG. 3.

TABLE 2

| Substance | Partition Coefficient Log P at 25° C. | Migration Amount into Tobacco Shreds (mmol/cig.) |
|---|---|---|
| Ethylene glycol | −1.36 | 0.895 |
| Propylene glycol | −0.92 | 0.774 |
| 1 3-butanediol | −0.74 | 0.252 |
| Diethyl succinate | 1.26 | 0.105 |
| Tributyl phosphate | 4.54 | 0.008 |

As shown in Table 2 and FIG. 4, when tributyl phosphate having a partition coefficient Log P of 4.5 or more was used, almost no migration to the tobacco shreds occurred. That is, a substance having a partition coefficient Log P at 25° C. of 4.5 or more has poor affinity for tobacco shreds, and thus does not easily volatilize from a filter or the like. Therefore, migration of the substance into the tobacco shreds through vapor phase can be suppressed. The partition coefficient Log P of the substance is more preferably 6 or more. The upper limit of the partition coefficient Log P of the substance is not particularly limited, but is, for example, 29.

The partition coefficient Log P of glyceryl monooleate is 6.4. Therefore, migration of glyceryl monooleate into the tobacco shreds is unlikely to occur. The substance contained in the phenol scavenger according to the embodiment is preferably glyceryl monooleate.

For benzoic acid, zingerone, cyclotene, and maltol described as examples of the substances contained in the phenol scavenger, their HSP (phenol), vapor pressure Vp, dropping point, and partition coefficient Log P will be described.

Benzoic acid has an HSP (phenol) of 5.17, a vapor pressure Vp at 25° C. of 0.001 Pa, a dropping point of 122° C., and a Log P of 1.87.

Zingerone has an HSP (phenol) of 5.56, a vapor pressure Vp at 25° C. of 0 Pa, a dropping point of 54° C., and a Log P of 1.54.

Cyclotene has an HSP (phenol) of 5.37, a vapor pressure Vp at 25° C. of 0.029 Pa, a dropping point of 71° C., and a Log P of 0.22.

Maltol has an HSP (phenol) of 6.89, a vapor pressure Vp at 25° C. of 0.002 Pa, a dropping point of 78° C., and a Log P of −0.26.

It is preferable that the substance contained in the phenol scavenger be semisolid at room temperature. When semisolid, the substance can have a greater surface area when carried by the flavor inhalation article member as compared to when the substance is solid. Therefore, if the substance is semisolid, it is possible to increase the probability of contact with phenol, which is the component to be scavenged, and therefore, the phenol selective filtering performance can be enhanced. Furthermore, when semisolid, the substance does not easily leak out of a member carrying the substance as compared to when the substance is liquid. Therefore, even when this substance is semisolid at room temperature, a stain is not easily caused on the cigarette paper or tipping paper.

The flavor inhalation article member according to the embodiment includes a base member. The base member is, for example, a flavor inhalation article member used in combination with a tobacco material. The base member may be at least one of a member constituting a smoking article, a member constituting a non-combustion heating type flavor inhalation article, or a member constituting a non-combustion non-heating type flavor inhalation article. A smoking article is an article that provides tobacco flavor to a user by burning a tobacco material. A non-combustion heating type flavor inhalation article is an article that provides tobacco flavor to a user by heating a tobacco material without burning the tobacco material. A non-combustion non-heating type flavor inhalation article is an article that provides tobacco flavor to a user without burning or heating the tobacco material. The tobacco material is, for example, tobacco shreds. A material of the tobacco shreds is not particularly limited, and known materials such as lamina and stem can be used.

2. Flavor Inhalation Article

A cigarette, which is a representative example of a smoking article including a tobacco material, will be described below with reference to the drawings.

<2-1. Smoking Article>

An example of a smoking article will be described with reference to FIG. 5.

Figure 5:
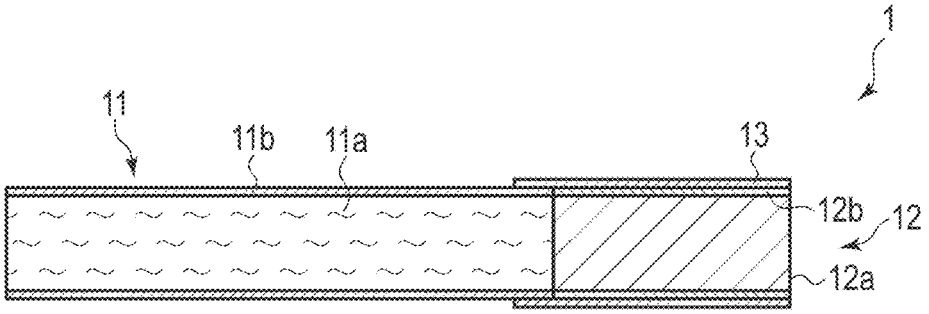
FIG. 5 is a cross-sectional view showing an example of a smoking article.

FIG. 5 is a cross-sectional view of a smoking article 1. The smoking article 1 shown in FIG. 5 is a cigarette.

The smoking article 1 shown in FIG. 5 includes a tobacco rod 11, a filter 12, and tipping paper 13. The tobacco rod 11 includes a tobacco material 11*a* (tobacco shreds), and cigarette paper 11*b* wrapped around the tobacco material 11*a*. The filter 12 here consists of a single filter plug. The filter plug includes a filter material 12*a*, and a wrapper 12*b* wrapped around the filter material 12*a*. The tipping paper 13 is wrapped on the tobacco rod 11 and the filter 12 to connect the tobacco rod 11 and the filter 12.

The base member included in the flavor inhalation article member according to the embodiment is, for example, at least one selected from the group consisting of the cigarette paper 11*b*, the filter material 12*a*, the wrapper 12*b*, and the tipping paper 13. The above-described phenol scavenger is carried by the base member.

The amount of the substance contained in the phenol scavenger is, for example, in a range from 5 parts by mass to 35 parts by mass, and preferably in a range from 10 parts by mass to 30 parts by mass, with respect to 100 parts by mass of the base member. This amount may also be in a range from 5 parts by mass to 15 parts by mass, in a range from 15 parts by mass to 25 parts by mass, or in a range from 25 parts by mass to 35 parts by mass. If this amount is excessively small, the absolute amount of filterable phenol decreases, which is not preferable. If this amount is excessively large, the phenol scavenger may leak out from the flavor inhalation article member to cause stains on the cigarette paper, wrapper, and/or tipping paper included in the flavor inhalation article, and in some cases, a stain may also be caused in a package packing the flavor inhalation article. That is, there is a possibility that an appearance of the flavor inhalation article or the like will be impaired, which is not preferable. As shown in Examples described later, in order to increase a temporal stability of the phenol selective filtering performance under relatively high temperature storage conditions (e.g., 35° C. or higher), the amount of the substance carried by the base member is preferably in a range from 5 parts by mass to 15 parts by mass.

It is preferable that an antioxidant be further carried by the base member that carries the phenol scavenger. In particular, if the substance contained in the phenol scavenger is a highly unsaturated fatty acid such as glyceryl monooleate, the highly unsaturated fatty acid generates a peculiar odor by oxidation. If an antioxidant is carried by the base member, oxidation of the substance described above can be suppressed, so that generation of a particular odor can be suppressed and an excellent flavor can be maintained. An example of the antioxidant includes tocopherol.

The base member may further contain an adsorbent to enhance phenol selective filtering performance, a capsule to control flavorant release function, a colorant, or the like. Various adsorbent particles such as activated carbon particles may be carried by the base member.

Figure 7:
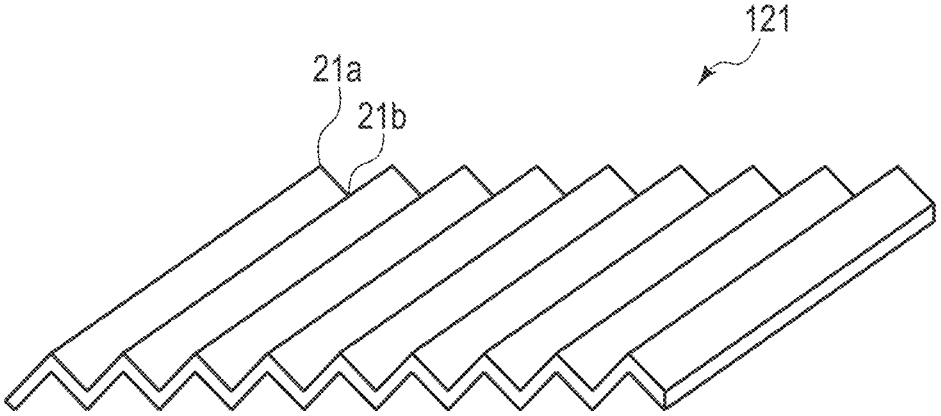
FIG. 7 is a perspective view showing an example of a corrugated film.

The filter material preferably includes a sheet material. The sheet material is preferably corrugated as a corrugated film (creped film) 121 shown in FIG. 7. The corrugated film 121 refers to a film having bellows-like folds, that is, a film in which ridge portions 21*a* and valley portions 21*b* are arranged alternately (see FIG. 7).

Figure 6:
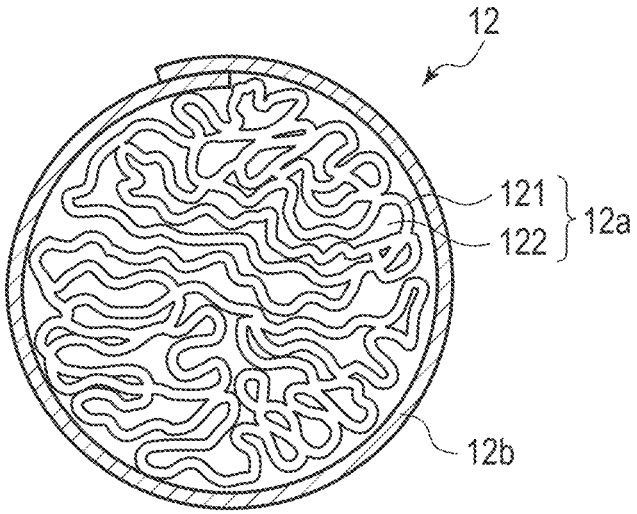
FIG. 6 is a cross-sectional view showing an example of a filter including a filter material made of a sheet material.

FIG. 6 shows a cross-sectional view of the filter 12 including the filter material 12*a* formed from the corrugated film 121, and the wrapper 12*b* wrapped around the filter material 12*a*. Here, in the filter material 12*a*, the corrugated film 121 is bent or folded so as to form a plurality of air flow paths 122 each extending from an end surface on the tobacco material side to an end surface on the mouthpiece side. Apparatus for wrapping such a corrugated film with a wrapper are disclosed in, for example, Jpn. Pat. Appln. KOKAI Publication Nos. 2002-204683, H09-294577, and H09-294576.

Examples of the sheet material include paper and a film formed from a melted film material. Examples of the film formed from the melted film material include a film made of a thermoplastic resin.

The sheet material is preferably paper. Paper is a highly biodegradable material and is preferable from the viewpoint of environmental protection.

However, if not carrying an additive such as a phenol scavenger, a filter using paper as a sheet material, i.e., a paper filter, has a low ability to filter a semivolatile component such as phenol. In addition, the paper filter has a large specific surface area, and an additive such as a phenol scavenger easily volatilizes when carried by the paper filter. Accordingly, if a paper filter is used as a filter carrying the phenol scavenger according to the embodiment, the effect of improving the storage stability is higher as compared to when other filters are used.

A basis weight of paper is, for example, in a range from 20 $g/m^2$ to 120 $g/m^2$, preferably in a range from 25 $g/m^2$ to 45 $g/m^2$. If the filter length is 120 mm, a ventilation resistance of the filter including paper as a filter material is, for example, in a range from 100 mmAq to 800 mmAq, preferably in a range from 200 mmAq to 600 mmAq. The basis weight of paper is preferably about 40 $g/m^2$. If the filter length is 120 mm, a ventilation resistance of the filter including paper as the filter material is preferably about 400 mmAq.

The filter material may be composed of acetate tow. Acetate tow can have, for example, a single yarn fineness of 1.9 to 8.6 (g/9000 m), a total fineness of 17000 to 44000 (g/9000 m), a number of fibers of 2400 to 23500 (fibers), and a ventilation resistance of 100 to 600 ($mmH_2O$/120 mm).

The filter may include two or more filter plugs. When the filter includes a plurality of filter plugs, the filter plug on the tobacco material side and the filter plug on the mouthpiece side may have the same material and structure or may have different materials and structures. When the filter includes two filter plugs, for example, a paper filter can be employed as one filter plug and a cellulose acetate filter or a charcoal filter can be employed as the other filter plug. If the filter includes two or more filter plugs, it is preferable that a phenol scavenger be carried by at least one of these filter plugs.

The filter plug containing the phenol scavenger according to the embodiment is preferably not in contact with the tobacco rod. In this case, it is possible to suppress migration of the phenol scavenger into the tobacco material due to the filter plug containing the phenol scavenger coming into contact with the tobacco material.

As a tobacco rod, a known tobacco rod can be used. The tobacco rod is made of, for example, a tobacco material and cigarette paper wrapped around the tobacco material, and can have, for example, a peripheral length of about 14 to 26 mm and a length of 15 to 70 mm. The cigarette paper preferably has oil resistance. When cigarette paper having oil resistance is used, a stain is less likely to occur even when the phenol scavenger leaks out from the base member.

<2-2. Non-Combustion Heating Type Flavor Inhalation Article>

The flavor inhalation article member according to the embodiment may be one of members constituting a non-combustion heating type flavor inhalation article. Hereinafter, an example of a non-combustion heating type flavor inhalation article will be described with reference to FIGS. 8 to 10, and an example of an aerosol generation device used when a user heats the non-combustion heating type flavor inhalation article will be described.

Figure 8:
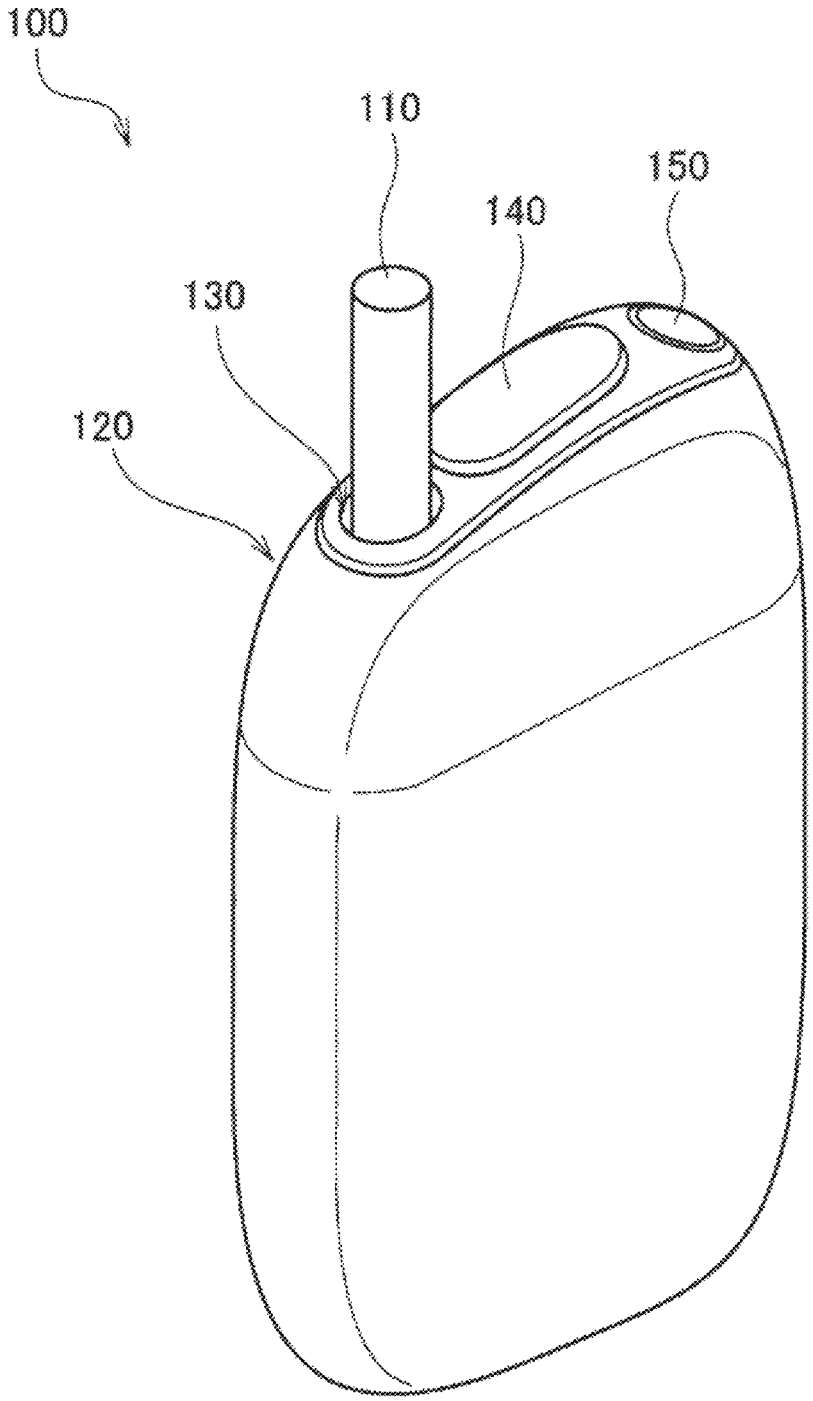
FIG. 8 is a perspective view showing an example of a heating type flavor inhaler.
Figure 9:
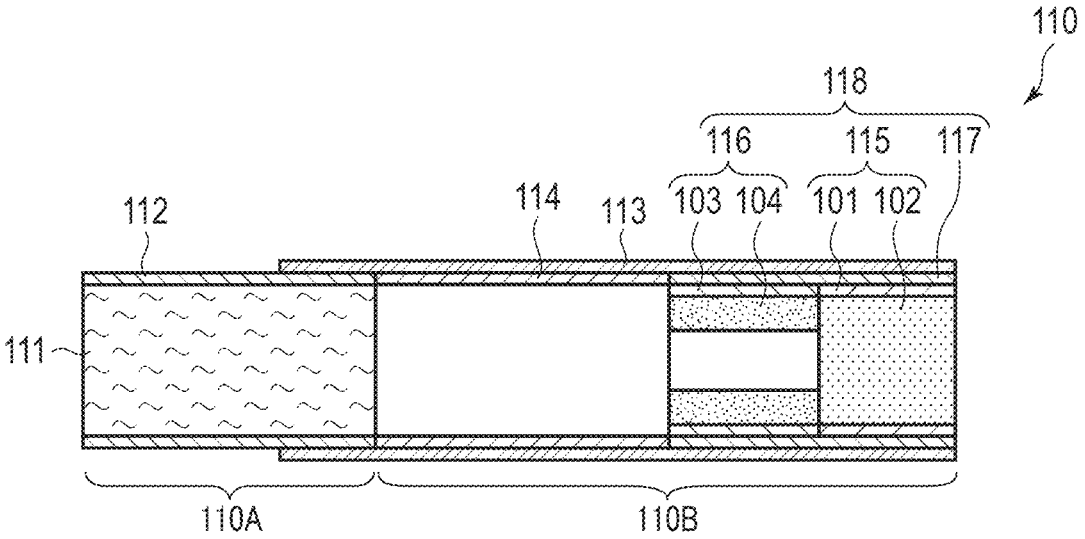
FIG. 9 is a cross-sectional view showing an example of a non-combustion heating type flavor inhalation article.
Figure 10:
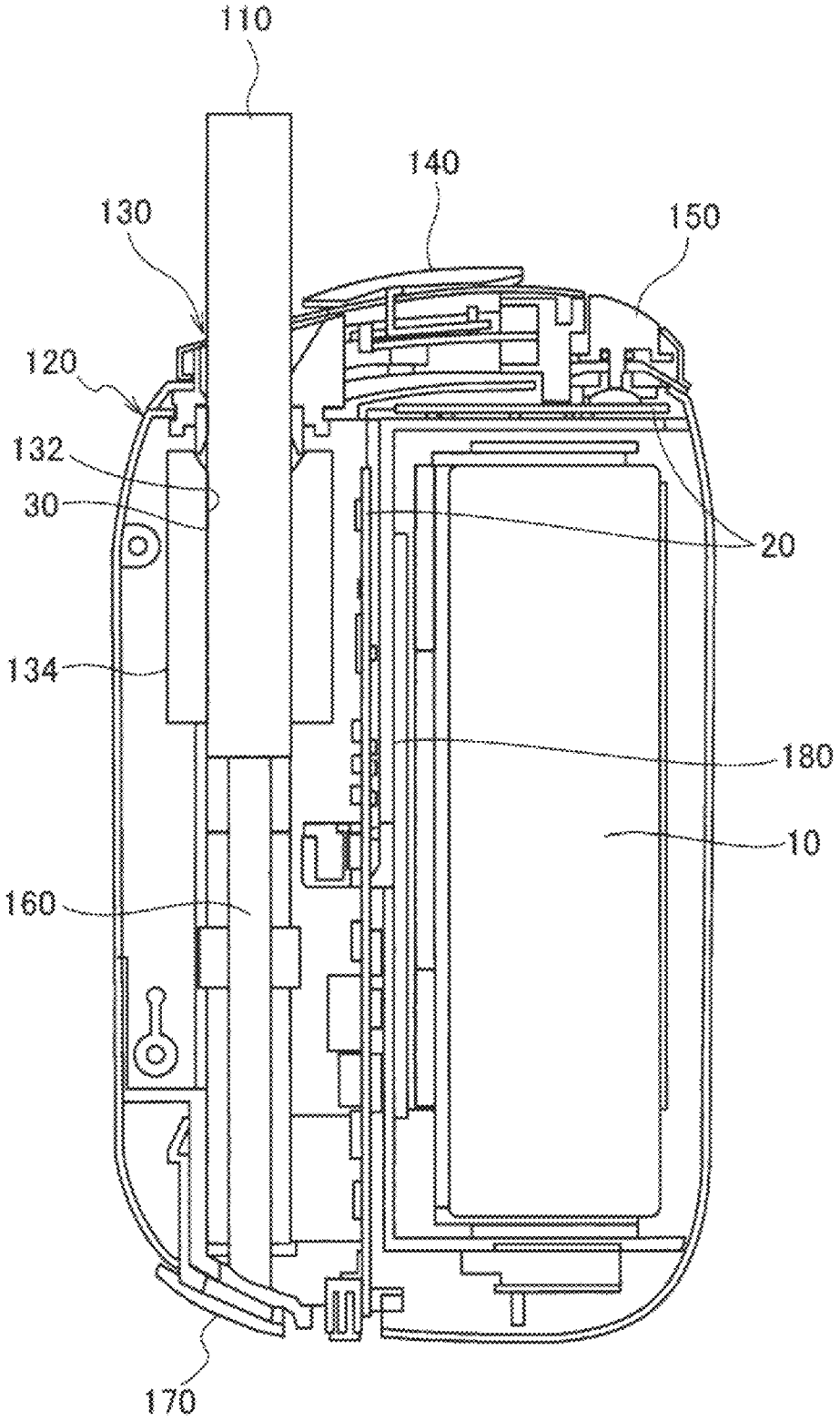
FIG. 10 is a view showing an internal structure of an aerosol generation device.

FIG. 8 is a perspective view showing an example of a heating type flavor inhaler. FIG. 9 is a cross-sectional view of a flavor inhalation article. FIG. 10 is a view showing an internal structure of an aerosol generation device.

As shown in FIG. 8, a flavor inhaler 100 includes:

a flavor inhalation article 110 including a tobacco material and an aerosol source; and an aerosol generation device 120 configured to heat the flavor inhalation article 110 to atomize an aerosol source and release a flavor component from the tobacco material.

The flavor inhalation article 110 is a replaceable cartridge and has a columnar shape extending along one direction. The flavor inhalation article 110 is configured to generate an aerosol and a flavor component by being heated while inserted into the aerosol generation device 120.

As shown in FIG. 9, the flavor inhalation article 110 includes a base portion 110A forming one end thereof and including a filler 111 and first cigarette paper 112 wrapped around the filler 111, and a mouthpiece portion 110B forming an end opposite to the base portion 110A. The base portion 110A and the mouthpiece portion 110B are connected by second cigarette paper 113.

The mouthpiece portion 110B includes a paper tube portion 114 and a filter 118 adjacent thereto. The filter 118 includes a filter plug 115, a hollow plug 116, and forming paper 117 covering them to connect them. The paper tube portion 114 is a paper tube formed by wrapping paper into a cylindrical shape, and has a hollow inside. The hollow plug 116 is disposed between the paper tube portion 114 and the filter plug 115.

The filter plug 115 includes a filter material 102 and a first plug wrapper 101 wrapped around the filter material 102. The filter material 102 is preferably a paper filter. As the filter material 102, a cellulose acetate filter or a charcoal filter may be employed.

The hollow plug 116 includes a filling layer 104 and a second plug wrapper 103 wrapped around the filling layer 104. The filling layer 104 is composed of fibers filled at a high density, and has one or a plurality of channels (hollow portions). The one or more channels each extend in a length direction (hereinafter, a longitudinal direction) of the flavor inhalation article 110. Therefore, during inhalation, air or aerosol flows only through the channels and flows very little through gaps between the fibers. In the flavor inhalation article 110, when it is desired to reduce the decrease in aerosol components through filtration in the filter plug 115, it is effective to shorten the length of the filter plug 115 and replace it with the hollow plug 116 in order to increase a delivery amount of aerosol.

As shown in FIG. 9, the filter 118 may include two or more filter plugs or may include only one filter plug. For example, the filter 118 may omit the hollow plug 116 and include only the filter plug 115. That is, the paper tube portion 114 and the filter plug 115 may be disposed adjacent to each other to form the mouthpiece portion 110B. If the filter 118 includes two or more filter plugs, it is preferable that the phenol scavenger according to the embodiment be carried by at least one of the filter plugs, as described in the section of the smoking article.

If the filter 118 includes two or more filter plugs, the filter plug carrying the phenol scavenger may be provided at a position of the end on the mouthpiece side in the mouthpiece portion 110B, for example, at a position corresponding to the filter plug 115 illustrated in FIG. 9, or may be provided at a position corresponding to the hollow plug 116.

Although the mouthpiece portion 110B is composed of two segments of the paper tube portion 114 and the filter 118, the mouthpiece portion 110B may be composed of one segment or may be composed of three or more segments.

Although not shown in the figures, the mouthpiece portion 110B may be provided with an opening to take in air from the outside in order to appropriately adjust the ventilation resistance of the flavor inhalation article 110. In this case, it is desirable to provide an opening in the paper tube portion 114.

The base member included in the flavor inhalation article member according to the embodiment is, for example, at least one selected from the group consisting of the first cigarette paper 112, the second cigarette paper 113, the paper tube portion 114, the filter 118, and the forming paper 117. It is preferable that the base member carrying the phenol scavenger be at least one of the members constituting the filter 118. It is more preferable that the base member carrying the phenol scavenger be at least one selected from the group consisting of the filter material 102 and the filling layer 104.

The flavor inhalation article 110 has a size in the longitudinal direction, i.e., a length, of preferably 40 to 90 mm, more preferably 50 to 75 mm, and further preferably 50 to 60 mm. The flavor inhalation article 110 has a peripheral length of preferably 15 to 25 mm, more preferably 17 to 24 mm, and further preferably 20 to 23 mm. In the flavor inhalation article 110, the base portion 110A may have a length of 20 mm, the paper tube portion 114 may have a length of 20 mm, the hollow plug 116 may have a length of 8 mm, and the filter plug 115 may have a length of 7 mm, and the lengths of these individual segments can be changed as appropriate according to manufacturing suitability, required quality, and the like.

The filler 111 includes a tobacco material and an aerosol source.

The aerosol source is heated at a predetermined temperature to generate an aerosol. The aerosol source may be, for example, glycerin, propylene glycol, triacetin, 1,3-butanediol, or a mixture thereof. The content of the aerosol source in the filler 111 is not particularly limited, and from the viewpoint of generating a sufficient amount of aerosol and providing a good flavor, the content is usually 5% by mass or more, and preferably 10% by mass or more, and usually 50% by mass or less, preferably 25% by mass or less.

The filler 111 includes a tobacco material as a flavor source. The tobacco material is, for example, tobacco shreds. When the base portion 110A has a peripheral length of 22 mm and a length of 20 mm, the content of the filler 111 in the flavor inhalation article 110 is, for example, 200 to 400 mg, and preferably 250 to 320 mg. The moisture content of the filler 111 is, for example, 8 to 18% by mass, and preferably 10 to 16% by mass. Such a moisture content suppresses occurrence of a stain on the wrapping paper and improves roll-up machinability during production of the base portion 110A.

The size of the tobacco shreds used in the filler 111 and the method for preparing them are not particularly limited. For example, dried tobacco leaf cut to have a width of 0.8 to 1.2 mm may be used. Alternatively, dried tobacco leaf may be pulverized and homogenized to have an average particle size of about 20 to 200 μm, processed into a sheet, and then cut to have a width of 0.8 to 1.2 mm. Further, the above sheet-processed material that is gathered instead of being cut may be used as the tobacco material.

For the first cigarette paper 112 and second cigarette paper 113, the same cigarette paper and tipping paper as those used in cigarettes can be used. For the first plug wrapper, second plug wrapper, and forming paper 117, the same wrappers as those used in cigarettes can be used.

As shown in FIG. 10, the aerosol generation device 120 includes an insertion hole 130 into which the flavor inhalation article 110 can be inserted. That is, the aerosol generation device 120 includes an inner cylindrical member 132 constituting the insertion hole 130. The inner cylindrical member 132 may be formed of a heat conductive material such as aluminum or stainless steel (SUS).

Further, the aerosol generation device 120 may include a lid portion 140 that closes the insertion hole 130. The lid portion 140 is slidable, and can change its state between a state where the insertion hole 130 is closed and a state where the insertion hole 130 is exposed (see FIG. 8).

The aerosol generation device 120 may include an air flow path 160 communicating with the insertion hole 130. One end of the air flow path 160 is connected to the insertion hole 130, while the other end of the air flow path 160 communicates with the outside (outside air) of the aerosol generation device 120 at a portion different from the insertion hole 130.

The aerosol generation device 120 may include a lid portion 170 that covers an end portion of the air flow path 160 on the side communicating with the outside air. The lid portion 170 can provide a state in which the end portion of the air flow path 160 on the side communicating with the outside air is covered or a state in which this end portion is exposed.

Here, the lid portion 170 is in a state of covering the end portion of the air flow path 160, but does not air-tightly close the air flow path 160. That is, the lid portion 170 is in a state of covering the air flow path 160, but is separated from the end portion of the air flow path 160, and is configured to allow outside air to flow into the air flow path 160 through the gap.

In a state where the flavor inhalation article 110 is inserted into the aerosol generation device 120, the user holds one end portion of the flavor inhalation article 110, specifically, the mouthpiece portion 110B illustrated in FIG. 9, and performs an inhalation action. The outside air flows into the air flow path 160 through the user's inhalation action. The air flowing into the air flow path 160 passes through the flavor inhalation article 110 in the insertion hole 130 and is guided into an oral cavity of the user.

The aerosol generation device 120 may include a temperature sensor in the air flow path 160 or on an outer surface of a wall portion constituting the air flow path 160. The temperature sensor may be, for example, a thermistor, a thermocouple, or the like. When the user inhales with the mouthpiece portion 110B of the flavor inhalation article 110, the internal temperature of the air flow path 160 or the temperature of the wall portion constituting the air flow path 160 decreases because of the influence of the air flowing through the air flow path 160 from the lid portion 170 side toward a later described heater 30 side. The temperature sensor can detect the user's inhalation action by measuring this temperature drop.

The aerosol generation device 120 includes a battery 10, a control unit 20, and a heater 30. The battery 10 stores electric power used in the aerosol generation device 120. The battery 10 may be a chargeable and dischargeable secondary battery. The battery 10 may be, for example, a lithium ion battery.

The heater 30 may be provided around the inner cylindrical member 132. The space accommodating the heater 30 and the space accommodating the battery 10 may be separated from each other by a partition wall 180. This can prevent the air heated by the heater 30 from flowing into the space accommodating the battery 10. Therefore, an increase in the temperature of the battery 10 can be suppressed.

The heater 30 preferably has a cylindrical shape capable of heating the outer periphery of the columnar flavor inhalation article 110. The heater 30 may be, for example, a film heater. The film heater may include a pair of film-like substrates and a resistance heating element sandwiched between the pair of substrates. The film-like substrate is preferably made of a material excellent in heat resistance and electrical insulating properties, and is typically made of polyimide. The resistance heating element is preferably made of one or two or more of metal materials such as copper, nickel alloy, chromium alloy, stainless steel, and platinum rhodium, and may be formed of, for example, a base material made of stainless steel. Further, in order to connect the resistance heating element to a power source via a flexible printed circuit (FPC), copper plating may be applied to a connection portion and a lead portion thereof.

Preferably, a heat-shrinkable tube is provided outside the heater 30. The heat-shrinkable tube is a tube that shrinks in a radial direction through heat, and is made of, for example, a thermoplastic elastomer. The heater 30 is pressed against the inner cylindrical member 132 by the contraction action of the heat-shrinkable tube. This increases the adhesion between the heater 30 and the inner tubular member 132, thereby increasing conduction of the heat from the heater 30 to the flavor inhalation article 110 via the inner tubular member 132.

The aerosol generation device 120 may include a tubular thermal insulator on the outer side of the heater 30 in the radial direction, preferably on the outer side of the heat-shrinkable tube. The thermal insulator may serve to prevent the outer surface of the housing of the aerosol generation device 120 from reaching an excessively high temperature by blocking the heat of the heater 30. The thermal insulator may be made of an aerogel such as a silica aerogel, a carbon aerogel, or an alumina aerogel. The aerogel as a thermal insulator may typically be a silica aerogel having a high thermal insulation performance and relatively low manufacturing costs. However, the thermal insulator may be a fiber-based thermal insulator such as glass wool or rock wool, or a foam-based thermal insulator such as urethane foam or phenol foam. Alternatively, the thermal insulator may be a vacuum thermal insulator.

An outer cylindrical member 134 is provided outside the thermal insulator. The thermal insulator may be provided between the inner tubular member 132 facing the flavor inhalation article 110 and the outer tubular member 134. The outer cylindrical member 134 may be formed of a heat conductive material such as aluminum or stainless steel (SUS). It is preferable that the thermal insulator be provided in the sealed space.

The control unit 20 may include a circuit board, a central processing unit (CPU), a memory, and the like. The aerosol generation device 120 may include a notification unit for notifying the user of various kinds of information under the control of the control unit 20. The notification unit may be, for example, a light emitting element such as a light-emitting diode (LED), a vibration element, or a combination thereof.

Upon detecting an activation request from the user, the control unit 20 starts power supply from the battery 10 to the heater 30. The activation request from the user is made by, for example, an operation of a push button or a slide switch by the user, or an inhalation action of the user. The activation request of the user may be made by pressing of a push button 150. More specifically, the activation request of the user may be made by pressing the push button 150 in a state where the lid portion 140 is opened. Alternatively, the activation request of the user may be made by detection of an inhalation action of the user. The user's inhalation action can be detected by, for example, a temperature sensor as described above.

<2-3. Non-Combustion Non-Heating Type Flavor Inhalation Article>

The flavor inhalation article member according to the embodiment may be a non-combustion non-heating type flavor inhalation article member that provides a flavor of a tobacco material to a user without heating or burning the tobacco material. Examples of the non-combustion non-heating type flavor inhalation article include a non-heating type tobacco flavor inhaler (see, for example, WO 2012/023515) in which a refill-type cartridge containing a tobacco material is provided in an inhalation holder and a user inhales a tobacco flavor derived from the tobacco material at room temperature.

The flavor inhalation article according to the embodiment includes a flavor inhalation article member including a base member and a phenol scavenger that is carried by the base member and contains a substance satisfying the above formulae (1) to (3). The flavor inhalation article may be any one selected from the group consisting of 2-1. Smoking Article, 2-2. Non-Combustion Heating Type Flavor Inhalation Article, and 2-3. Non-Combustion Non-Heating Type Flavor Inhalation Article, described above.

3. Method for Producing Flavor Inhalation Article Member

The flavor inhalation article member according to the embodiment can be produced by a method including making a base member carry a phenol scavenger containing a substance satisfying the above formulae (1) to (3).

As a method for making the base member carry the phenol scavenger, for example, there is a method including heating the substance to a temperature equal to or higher than the dropping point to fluidize the substance, and then making the base member carry the substance. Alternatively, there is a method including preparing a solution by dissolving the substance in an appropriate organic solvent, supplying the solution to the base member, and then removing an organic solvent, thereby making the base member carry the substance.

Examples of the organic solvents for dissolving the substance include triacetin, propylene glycol, ethanol, and glycerin.

A method of making the base member carry the fluidized substance is not particularly limited. For example, the fluidized substance may be applied to or infiltrated into the base member. By applying or infiltrating the fluidized substance to or into the base member, the substance can be uniformly carried by the base member.

The substance can be applied to the base member through, for example, spray application. The substance can be infiltrated into the base member by, for example, dropping the substance using a syringe.

4. Other Embodiments

Hereinafter, other embodiments will be described collectively.

[1] A flavor inhalation article member, comprising:
a base member; and
a phenol scavenger carried by the base member and comprising a substance satisfying formulae (1) to (3) below:

$$HSP(\text{phenol}) \leq 8 \quad (1)$$

$$Vp \leq 0.2 \text{ Pa} \quad (2)$$

$$DP \geq 50^\circ \text{ C.} \quad (3)$$

where the HSP (phenol) is a distance between a Hansen solubility parameter of the substance and a Hansen solubility parameter of phenol, the Vp is a vapor pressure of the substance, and the DP is a dropping point of the substance.

[2] The flavor inhalation article member according to [1], wherein the base member is used in combination with a tobacco material including tobacco shreds.

[3] The flavor inhalation article member according to [1] or [2], wherein the base member is a member constituting a smoking article, a member constituting a non-combustion heating type flavor inhalation article, or a member constituting a non-combustion non-heating type flavor inhalation article.

[4] The flavor inhalation article member according to [3], wherein the smoking article comprises a tobacco rod, a filter including a filter material, and tipping paper.

[5] The flavor inhalation article member according to [4], wherein the base member is the filter.

[6] The flavor inhalation article member according to [4] or [5], wherein the filter material includes a sheet material, and the phenol scavenger is carried by the sheet material.

[7] The flavor inhalation article member according to [6], wherein the sheet material is paper.

[8] The flavor inhalation article member according to [3], wherein the non-combustion heating type flavor inhalation article comprises a base portion including a filler including the tobacco material and cigarette paper wrapped around the filler and forming one end, and a mouthpiece portion forming an end opposite to the base portion, and the mouthpiece portion comprises a paper tube portion and a filter adjacent to the paper tube portion and including a filter material.

[9] The flavor inhalation article member according to [8], wherein the base member is the filter.

[10] The flavor inhalation article member according to [8] or [9], wherein the filter material includes a sheet material, and the phenol scavenger is carried by the sheet material.

[11] The flavor inhalation article member according to [10], wherein the sheet material is paper.

[12] The flavor inhalation article member according to any one of [1] to [11], wherein the substance is semi-solid at room temperature.

[13] The flavor inhalation article member according to any one of [1] to [12], wherein the substance has a partition coefficient Log P of 4.5 or more.

[14] The flavor inhalation article member according to any one of [1] to [13], wherein the substance is at least one selected from the group consisting of glyceryl monooleate, benzoic acid, zingerone, cyclotene, and maltol.

[15] The flavor inhalation article member according to any one of [1] to [14], wherein an amount of the substance is in a range from 5 parts by mass to 35 parts by mass with respect to 100 parts by mass of the base member.

[16] The flavor inhalation article member according to any one of [1] to [15], further comprising an antioxidant.

[17] A flavor inhalation article comprising the flavor inhalation article member according to any one of [1] to [16].

EXAMPLES

Hereinafter, examples will be described, but the present invention is not limited to the examples described below.

[Example 1] Evaluation of Phenol Selective Filtering Performance

<Production of Cigarette Samples>

(Production of Cigarette Sample 1)

First, a paper filter having a length of 27 mm and a diameter of 7.7 mm was prepared. Specifically, first, corrugated paper (basis weight 40 g/m$^2$) was bent or folded so as to form a plurality of air flow paths each extending from one end to the other end, thereby producing a rod having a length of 120 mm and a ventilation resistance of 400 mmAq. This rod was cut into a length of 27 mm, and the filter material thus obtained was wrapped with a paper tube, which is a wrapper, having a length of 27 mm and a diameter of 7.7 mm, thereby producing a paper filter.

Next, the filter material of the filter was made to carry 10 parts by mass of commercially available glyceryl monooleate (MGO) with respect to 100 parts by mass of the filter material. When glyceryl monooleate was carried, it was heated to 50° C. to be fluidized, and then carried using a microsyringe so as to have a uniform mass along the longitudinal direction of the filter material. Thereafter, the tobacco rod of commercially available MEVIUS SUPER LIGHTS and the above-described filter were bonded to each other to produce cigarette sample 1.

(Production of Cigarette Sample 2)

Cigarette sample 2 was produced in the same manner as the cigarette sample 1 except that the amount of glyceryl monooleate carried by the filter material was 20 parts by mass.

(Production of Cigarette Sample 3)

Cigarette sample 3 was produced in the same manner as the cigarette sample 1 except that the amount of glyceryl monooleate carried by the filter material was 30 parts by mass.

(Production of Cigarette Samples 4 to 6)

Cigarette samples 4 to 6 were produced in the same manner as the cigarette samples 1 to 3, respectively, except that triacetin (GTA) was used instead of glyceryl monooleate.

Triacetin has an HSP (phenol) of 7.18, a vapor pressure Vp of 0 Pa, a dropping point DP of 4° C., and a partition coefficient log P of 0.25.

(Production of Cigarette Sample 7)

Cigarette Sample 7 was produced in the same manner as the cigarette sample 1 except that no additive was carried by the filter material.

(Production of Cigarette Sample 8)

Cigarette sample 8 was produced in the same manner as the cigarette sample 1 except that only the paper tube was bonded to the tobacco rod instead of the filter. The cigarette sample 8 was used as a standard sample.

<Smoking Test>

Each of the eight cigarette samples was subjected to a smoking test in accordance with ISO smoking conditions under three conditions of immediately after production, after storage for one month in an environment of 22° C. and 60% RH, and after storage for one month in an environment of 35° C. and 60% RH.

Specific smoking conditions are as follows. An automatic smoking machine (Cerulean SM410) was used to automatically smoke the cigarette samples under conditions of a puff volume of 17.5 mL/sec, a puff duration of 2 sec/puff, and a puff frequency of 1 puff/min, and tobacco smoke particulate matter (TPM) was collected by a Cambridge filter (Borgwaldt 44 mm Φ). A TPM mass was measured from the difference in mass of the Cambridge filter before and after smoking. Thereafter, the Cambridge filter was immersed in 10 mL of the phenol extraction solvent shown in Table 3 below placed in the screw tube bottle and shaken to obtain an analysis sample. 1 μL of the obtained analysis sample was collected with a microsyringe, and analyzed by a gas chromatography-mass selective detector (GC-MSD). Agilent G7890A manufactured by Agilent Technologies Inc. was used as GC, and Agilent_5795C manufactured by Agilent Technologies Inc. was used as MSD.

TABLE 3

| | Compound | Concentration |
|---|---|---|
| Solvent | t-Butyl Methyl Ether | — |
| Internal standard | o-chlorophenol | 9.15 μg/ml |

The TPM mass per cigarette and the amount of phenol in the tobacco smoke were measured for each cigarette sample by the above method. From these results, a phenol selective filtration index Sx, which will be described later, was calculated, and based on this, a temporal stability of the phenol scavenging ability was evaluated.

Specifically, first, the above-described component amounts were applied to the following equations (I) and (II) to calculate TPM filtration efficiency $E_{TPM}$ and phenol filtration efficiency $E_{phenol}$ for each cigarette sample.

$$E_{TPM} = (A_{TPM,std} - A_{TPM,smp}) / (A_{TPM,std}) \quad \text{(I)}$$

$$E_{phenol} = (A_{phenol,std} - A_{phenol,smp}) / (A_{phenol,std}) \quad \text{(II)}$$

In the above equation (I), $A_{TPM,std}$ is a TPM amount of the cigarette sample 8 as a standard sample, and $A_{TPM,smp}$ is a TPM amount of each cigarette sample. In the above equation (II), $A_{phenol,std}$ is an amount of phenol in smoke of the cigarette sample 8 as a standard sample, and $A_{phenol,smp}$ is an amount of phenol in smoke of each cigarette sample.

For each cigarette sample, two samples produced under the same conditions were prepared and subjected to the test described above. For each of the cigarette samples produced under the same conditions, TPM filtration efficiency $E_{TPM}$ and phenol filtration efficiency $E_{phenol}$ were obtained. These two values were averaged to determine TPM filtration efficiency $E_{TPM}$ and phenol filtration efficiency $E_{phenol}$ of the corresponding cigarette sample.

Subsequently, TPM filtration efficiency $E_{TPM}$ and phenol filtration efficiency $E_{phenol}$ obtained for each cigarette sample were applied to the following equation (III) to calculate phenol selective filtration index Sx. In equation (III), $(1-E_{TPM})$ represents a TPM transmission rate and $(1-E_{phenol})$ represents a phenol transmission rate.

$$Sx=(1-E_{TPM})/(1-E_{phenol}) \quad \text{(III)}$$

Since the phenol selective filtration index Sx in the above equation (III) is the ratio of $(1-E_{TPM})$ to $(1-E_{phenol})$ a higher phenol selective filtration index Sx means a higher phenol selective filtering performance of the corresponding cigarette sample. For example, if the amount of phenol filtered for a given cigarette sample is large, the phenol transmission rate $(1-E_{phenol})$ is small, and thus Sx is a large value.

The results are collectively shown in Table 4 below.

In Table 4 below, in the column entitled "Sample No.", the cigarette sample number used in the test and the number corresponding to the storage condition for that cigarette sample are hyphenated in this order. Specifically, for the test performed immediately after production, the storage condition number "1" is given after the cigarette sample number. For the test performed after storage for one month in an environment of 22° C. and 60% RH, the storage condition number "2" is given after the cigarette sample number. For the test performed after storage for one month in an environment of 35° C. and 60% RH, the storage condition number "3" is given after the cigarette sample number.

For example, the number "1-1" is given to the cigarette sample 1 tested immediately after production, the number "1-2" is given to the cigarette sample 1 tested after storage for one month in an environment of 22° C. and 60% RH, and the number "1-3" is given to the cigarette sample 1 tested after storage for one month in an environment of 35° C. and 60% RH.

TABLE 4

| Sample No. | Type of Phenol Scavenger | Amount of Phenol Scavenger Added (parts by mass) | Storage Conditions | TPM Filtration Efficiency $E_{TPM}$ | Phenol Filtration Efficiency $E_{phenol}$ | Sx | Ratio Sx (after storage)/ Sx (before storage) |
|---|---|---|---|---|---|---|---|
| 1-1 | MGO | 10 | Immediately after production | 0.73 | 0.80 | 1.37 | — |
| 1-2 | MGO | 10 | One Month under Environment of 22° C. and 60% RH | 0.76 | 0.80 | 1.20 | 0.87 |
| 1-3 | MGO | 10 | One Month under Environment of 35° C. and 60% RH | 0.70 | 0.81 | 1.60 | 1.16 |
| 2-1 | MGO | 20 | Immediately after production | 0.72 | 0.83 | 1.63 | — |
| 2-2 | MGO | 20 | One Month under Environment of 22° C. and 60% RH | 0.74 | 0.83 | 1.54 | 0.95 |
| 2-3 | MGO | 20 | One Month under Environment of 35° C. and 60% RH | 0.65 | 0.77 | 1.54 | 0.95 |
| 3-1 | MGO | 30 | Immediately after production | 0.66 | 0.83 | 1.97 | — |
| 3-2 | MGO | 30 | One Month under Environment of 22° C. and 60% RH | 0.71 | 0.82 | 1.56 | 0.79 |
| 3-3 | MGO | 30 | One Month under Environment of 35° C. and 60% RH | 0.61 | 0.77 | 1.66 | 0.84 |
| 4-1 | GTA | 10 | Immediately after production | 0.77 | 0.92 | 2.74 | — |
| 4-2 | GTA | 10 | One Month under Environment of 22° C. and 60% RH | 0.80 | 0.90 | 1.95 | 0.71 |
| 4-3 | GTA | 10 | One Month under Environment of 35° C. and 60% RH | 0.71 | 0.84 | 1.82 | 0.67 |
| 5-1 | GTA | 20 | Immediately after production | 0.71 | 0.91 | 3.28 | — |
| 5-2 | OTA | 20 | One Month under Environment of 22° C. and 60% RH | 0.77 | 0.91 | 2.49 | 0.76 |
| 5-3 | GTA | 20 | One Month under Environment of 35° C. and 60% RH | 0.67 | 0.87 | 2.62 | 0.80 |
| 6-1 | GTA | 30 | Immediately after production | 0.70 | 0.92 | 3.83 | — |
| 6-2 | GTA | 30 | One Month under Environment of 22° C. and 60% RH | 0.69 | 0.89 | 2.76 | 0.72 |
| 6-3 | GTA | 30 | One Month under Environment of 35° C. and 60% RH | 0.60 | 0.85 | 2.59 | 0.68 |
| 7-1 | none | — | Immediately after production | 0.77 | 0.77 | 1.04 | — |

TABLE 4-continued

| Sample No. | Type of Phenol Scavenger | Amount of Phenol Scavenger Added (parts by mass) | Storage Conditions | TPM Filtration Efficiency $E_{TPM}$ | Phenol Filtration Efficiency $E_{phenol}$ | Sx | Ratio Sx (after storage)/ Sx (before storage) |
|---|---|---|---|---|---|---|---|
| 7-2 | none | — | One Month under Environment of 22° C. and 60% RH | 0.76 | 0.73 | 0.92 | — |
| 7-3 | none | — | One Month under Environment of 35° C. and 60% RH | 0.69 | 0.73 | 1.13 | — |

If the results obtained for the cigarette sample 7 to which no phenol scavenger was added are compared to the results obtained for the cigarette sample 1 to which 10 parts by mass of MGO was added as a phenol scavenger, as shown in Table 4, the phenol selective filtration index Sx of the cigarette sample 1 to which MGO was added as a phenol scavenger was higher for all storage conditions. That is, the cigarette sample to which glyceryl monooleate was added had sufficient phenol selective filtering performance. Similarly, the cigarette samples 2 and 3 were also demonstrated to have sufficient phenol selective filtering performance.

[Example 2] Evaluation of Temporal Stability of Phenol Selective Filtering Performance In order to evaluate temporal stability of the phenol selective filtering performance, for the cigarette sample 1, a ratio of phenol selective filtration index Sx after storage (sample number 1-2 or 1-3) to phenol selective filtration index Sx immediately after production (sample number 1-1) [Sx (after storage)/Sx (before storage)] was calculated. The ratio [Sx (after storage)/Sx (before storage)] is an index to evaluate the storage stability.

Similarly, for each of the cigarette samples 2 to 6, the ratio [Sx (after storage)/Sx (before storage)] was calculated. Table 4 above also shows these results. For the cigarette sample 7 to which no phenol scavenger was added, the ratio [Sx (after storage)/Sx (before storage)] was not calculated because the value of Sx after storage did not change much from the value of Sx before storage.

Figure 11:
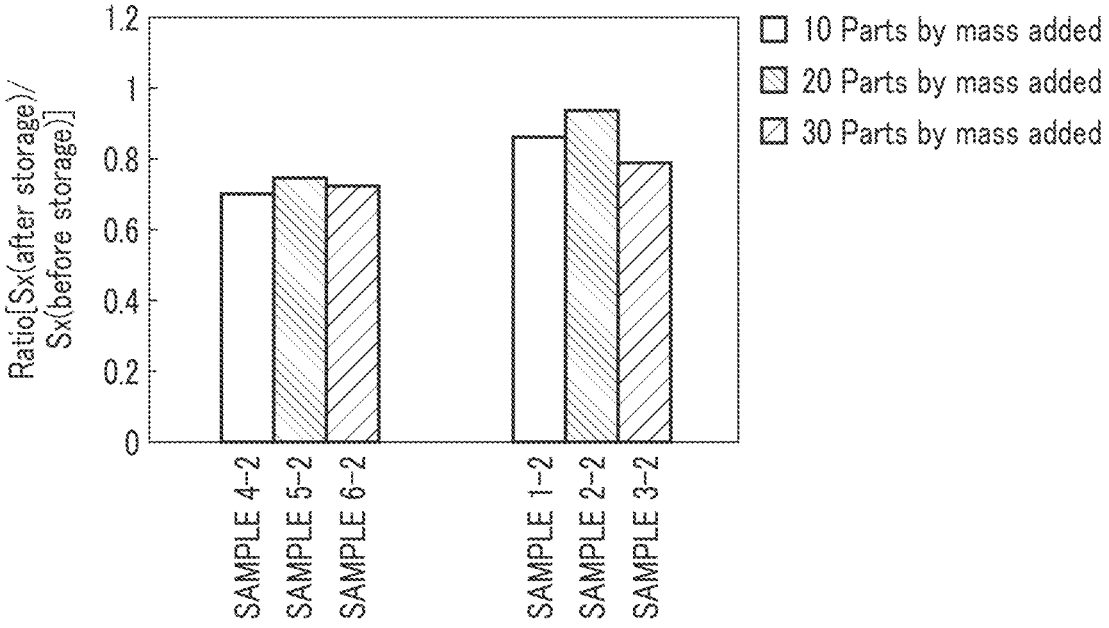
FIG. 11 is a graph for temporal stability of phenol selective filtering performance.
Figure 12:
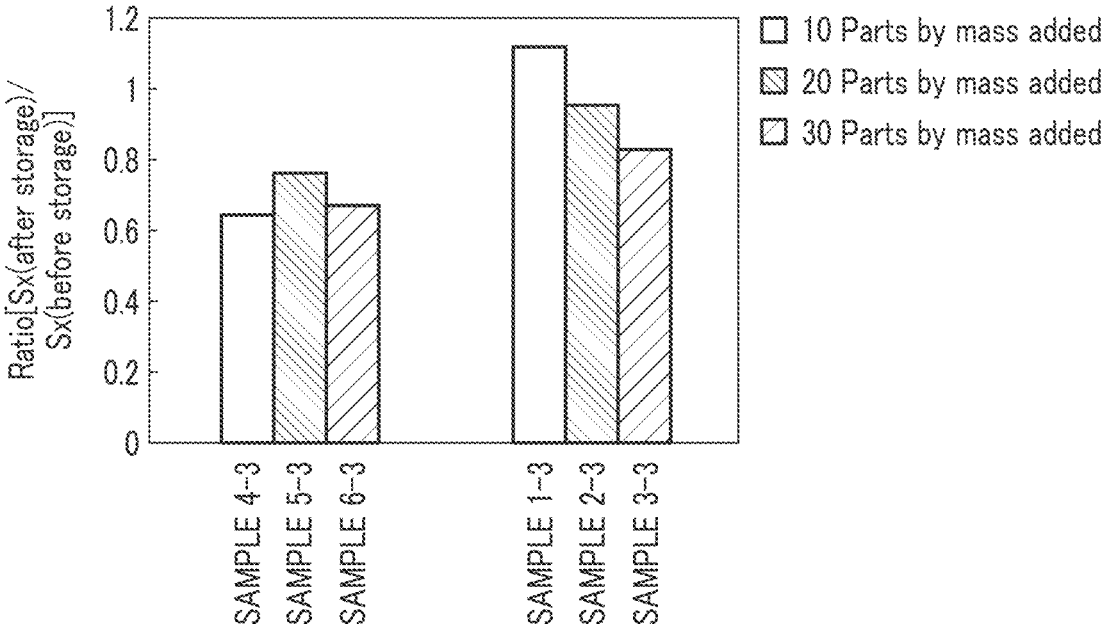
FIG. 12 is another graph for temporal stability of phenol selective filtering performance.

The results obtained for multiple cigarette samples with common storage conditions are collectively shown in FIGS. 11 and 12 as graphs for each storage condition. FIG. 11 is a graph showing the ratio [Sx (after storage)/Sx (before storage)] of the phenol selective filtration index Sx before and after storage for one month in an environment of 22° C. and 60% RH. FIG. 12 is a graph showing the ratio [Sx (after storage)/Sx (before storage)] of the phenol selective filtration index Sx before and after storage for one month in an environment of 35° C. and 60% RH. The closer the ratio [Sx (after storage)/Sx (before storage)] is to 1, the smaller the change in the phenol selective filtration index Sx before and after storage.

As shown in FIG. 11, for the cigarette samples 1 to 3 to which MGO was added as a phenol scavenger, regardless of the amount thereof added, the ratio [Sx (after storage)/Sx (before storage)] was close to 1, as compared to the cigarette samples 4 to 6 to which GTA was added. That is, under the conditions of storage for one month in an environment of 22° C. and 60% RH, the cigarette sample using MGO as the phenol scavenger was superior in storage stability to the cigarette sample using GTA as the phenol scavenger.

Further, as shown in FIG. 12, for the cigarette samples 1 to 3 to which MGO was added as a phenol scavenger, regardless of the amount thereof added, the ratio [Sx (after storage)/Sx (before storage)] was close to 1, as compared to the cigarette samples 4 to 6 to which GTA was added. That is, under the conditions of storage for one month in an environment of 35° C. and 60% RH, the cigarette sample using MGO as the phenol scavenger was superior in storage stability to the cigarette sample using GTA as the phenol scavenger.

Looking at the results obtained when the cigarette sample 1 was stored under the third condition, the ratio [Sx (after storage)/Sx (before storage)] exceeds 1. Although the reason for this is not clear, it can be recognized that when the flavor inhalation article is stored in a relatively high temperature environment, i.e., in an environment of 35° C. and 60% RH, it is particularly preferable to set the amount of MGO to about 10 parts by mass with respect to 100 parts by mass of the base member because Sx after storage exceeds Sx before storage.

[Example 3] Evaluation of Leakage of Phenol Scavenger

<Production of Filter Samples>

(Production of Filter Sample A)

First, a paper filter having a length of 27 mm and a diameter of 7.7 mm was prepared. Specifically, corrugated paper was bent or folded so as to form a plurality of air flow paths each extending from one end to the other end, thereby producing a rod having a length of 120 mm and a ventilation resistance of 400 mmAq. This rod was cut into a length of 27 mm, and the filter material thus obtained was wrapped with a paper tube, which is a wrapper, having a length of 27 mm and a diameter of 7.7 mm, thereby producing a paper filter.

Next, the filter was stood on cardboard (Rengo Co., Ltd.), and commercially available glyceryl monooleate (MGO) heated to 50° C. to be fluidized was dropped on the upper end surface of the filter using a microsyringe. The dropping amount was 10 parts by mass with respect to 100 parts by mass of the filter material (excluding the paper tube). This dropping amount is such an amount that the fluidized MGO does not come into contact with the cardboard.

In this manner, filter sample A was produced.

(Production of Filter Sample B)

Filter sample B was produced in the same manner as the filter sample A except that the amount of glyceryl monooleate carried by the filter material was 20 parts by mass.

(Production of Filter Sample C)

Filter sample C was produced in the same manner as the filter sample A except that the amount of glyceryl monooleate carried by the filter material was 30 parts by mass.

(Production of Filter Samples D to F)

Filter samples D to F were produced in the same manner as the filter samples A to C except that triacetin (GTA) was used instead of glyceryl monooleate.

<Leakage Test>

Figure 13:
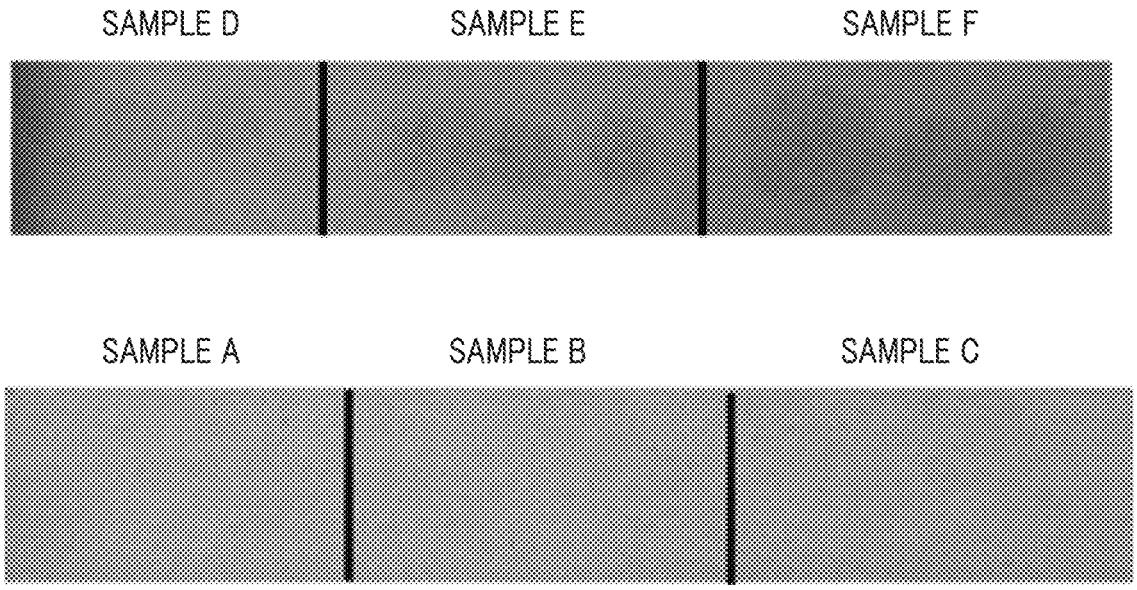
FIG. 13 is a photograph for leakage tests of a phenol scavenger.
Figure 14:
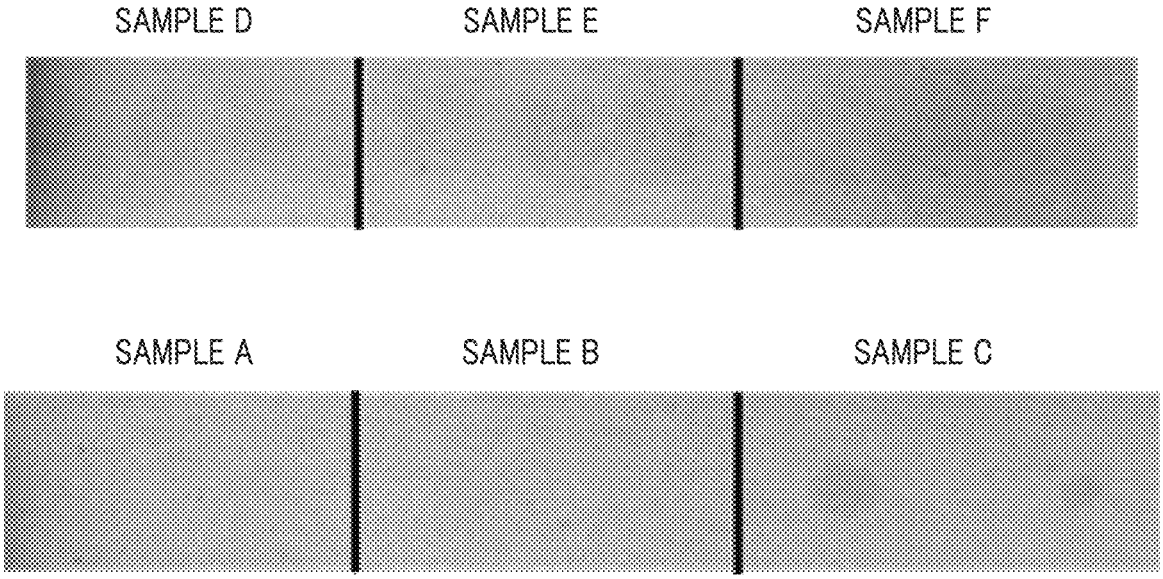
FIG. 14 is another photograph for the leakage tests of the phenol scavenger.

Each of the six filter samples was stored for one month in an environment of 22° C. and 60% RH while being placed on the cardboard, and the degree of leakage of MGO or GTA into the cardboard after storage was visually checked. In addition, each of the six filter samples was stored for one month in an environment of 35° C. and 60% RH while being placed on the cardboard, and the degree of leakage of MGO or GTA into the cardboard after storage was visually checked. FIG. 13 is a photograph showing the cardboard after storage for one month in an environment of 22° C. and 60% RH. FIG. 14 is a photograph showing the cardboard after storage for one month in an environment of 35° C. and 60% RH.

For the filter samples D to F containing triacetin (GTA), stains were clearly visually recognized on the cardboard under both of the conditions after storage for one month in an environment of 22° C. and 60% RH and after storage for one month in an environment of 35° C. and 60% RH. The stains were also observed for the sample D in which triacetin was added in an amount of 10 parts by mass with respect to 100 parts by mass of the paper filter, indicating that triacetin is likely to leak out during storage.

In contrast, for the filter samples A to C to which glyceryl monooleate (MGO) was added, no stain was observed except for the sample C to which MGO was added in an amount of 30 parts by mass. With respect to the sample C, some stains were visually recognized when stored for one month in an environment of 35° C. and 60% RH, but almost no stains were visually recognized when stored for one month in an environment of 22° C. and 60% RH. Therefore, it can be recognized that the amount of MGO added is desirably less than 30% with respect to the mass of the filter material from the viewpoint of leakage.

A phenol scavenger containing a substance that is semisolid at room temperature, such as MGO used in the above test, can significantly inhibit its leakage from the filter. Therefore, a filter material carrying a phenol scavenger containing a substance that is semisolid at room temperature can maintain good appearance of a flavor inhalation article including the filter material. Furthermore, a substance that is semisolid at room temperature such as MGO has a larger area that may come into contact with phenol as compared to a substance that is solid at room temperature, and therefore a flavor inhalation article having excellent phenol selective filtering performance can be easily realized.

The invention claimed is:

1. A flavor inhalation article, comprising:

a tobacco rod;

a filter positioned at one end of the tobacco rod, the filter connecting the tobacco rod by a wrapper and comprising a filter material; and a phenol scavenger directly carried by the filter material of the filter and comprising a substance satisfying formulae (1) to (3) below, the substance being at least one selected from the group consisting of glyceryl monooleate, benzoic acid, and zingerone, and wherein:

$$HSP \text{ (Hansen Solubility Parameter) (phenol)} \leq 8 \quad (1)$$

$$Vp \leq 0.2 \text{ Pa} \quad (2)$$

$$DP \geq 50° \text{ C.} \quad (3)$$

where the HSP (phenol) is a value between a Hansen solubility parameter of the substance and a Hansen solubility parameter of phenol, the Vp is a vapor pressure of the substance, and the DP is a dropping point of the substance.

2. The flavor inhalation article according to claim 1, wherein the substance is semisolid at room temperature.

3. The flavor inhalation article according to claim 1, wherein the substance has a partition coefficient Log P of 4.5 or more.

4. The flavor inhalation article according to claim 1, wherein the filter material comprises a sheet material, and the phenol scavenger is carried by the sheet material.

5. The flavor inhalation article according to claim 4, wherein the sheet material is paper.

6. The flavor inhalation article according to claim 1, wherein an amount of the substance is in a range from 5 parts by mass to 35 parts by mass with respect to 100 parts by mass of the base member.

7. The flavor inhalation article according to claim 1, further comprising an antioxidant.

8. A flavor inhalation article, comprising:

a tobacco rod;

a filter positioned at one end of the tobacco rod, the filter connecting the tobacco rod by a wrapper and comprising a filter material; and a phenol scavenger directly carried by the filter material of the filter and comprising a substance satisfying formulae (1) to (3) below, the substance being semisolid at room temperature, and wherein:

$$HSP \text{ (Hansen Solubility Parameter) (phenol)} \leq 8 \quad (1)$$

$$Vp \leq 0.2 \text{ Pa} \quad (2)$$

$$DP \geq 50° \text{ C.} \quad (3)$$

where the HSP (phenol) is a value between a Hansen solubility parameter of the substance and a Hansen solubility parameter of phenol, the Vp is a vapor pressure of the substance, and the DP is a dropping point of the substance.

* * * * *